US005883321A

United States Patent [19]

Hsieh

[11] Patent Number: 5,883,321

[45] Date of Patent: Mar. 16, 1999

[54] DRIVING DEVICE FOR CYMBALS

[76] Inventor: Wu-Hong Hsieh, No. 46, Lane 59, Chungcheng Rd., Luchou Hsiang, Taipei Hsien, Taiwan

[21] Appl. No.: 789,382

[22] Filed: Jan. 28, 1997

[51] Int. Cl.[6] ..... G10D 13/02

[52] U.S. Cl. ..... 84/422.3

[58] Field of Search ..... 84/422.1, 422.2, 84/422.3

[56] References Cited

U.S. PATENT DOCUMENTS

| | | | |
|---|---|---|---|
| 4,905,565 | 3/1990 | Hoshin | 84/422.3 |
| 4,945,802 | 8/1990 | Ruprecht | 84/422.1 |
| 5,717,152 | 2/1998 | Liao | 84/422.3 |

*Primary Examiner*—William M. Shoop, Jr.
*Assistant Examiner*—Kim Lockett
*Attorney, Agent, or Firm*—Bacon & Thomas, PLLC

[57] ABSTRACT

A cymbal device comprises a base mounted with a pedal, a tubular stanchion, a tripod for supporting the stanchion, a drive rod extending through the stanchion and a driving element for driving the drive rod to operate the cymbals. The driving element includes a pair of opposed plates vertically mounted on a side pillar of the base. A block is pivotedly mounted between the pair of plates. A periphery of the block arcuate. A chain is mounted to the periphery of the block and a top end of the chain is connected with the drive rod. An adjusting block has a lower end connected with the pedal and an upper end connected between the pair of plates.

5 Claims, 6 Drawing Sheets

DRIVING DEVICE FOR CYMBALS

BACKGROUND OF THE INVENTION

1. Field of the Invention

The present invention relates to a driving device for cymbals of a drumkit, and more particularly to a driving device for cymbals which operates with an accurate action and obtains an excellent performance.

2. Description of Related Art

Cymbals are commonly used in groups making music, such as bands, pop groups etc. Generally, a conventional driving device for a pair of cymbals has a structure as shown in FIG. 5 and FIG. 6. The driving device includes a base 90 mounted with a pedal 95, a tubular stanchion 92, a tripod 91 for supporting the stanchion 92, a drive rod 93 extending through the stanchion 92 and a connection lever 94 connecting the drive rod 93 with the pedal. When the pedal 95 is pressed downward by a user's foot, it-drives the connection lever 94 to pull down the drive rod 93 to operate cymbals (not shown). Though the method for driving the drive rod 93 is very simple and easy to operate, it still has a disadvantage. Referring to FIG. 6, when the pedal is pressed downward by a foot, a raised end of the pedal will pivot on a fixed end thereof and thus make an arcuate displacement. Therefore, the drive rod 93 may be applied with a force deflected away from a vertical direction when the pedal drives the drive rod 93 downward. Nevertheless, the downward movement of the drive rod 93 requires a downward force in a vertical direction. A conventional structure as shown in FIGS. 5 and 6 may result in slightly deflecting contact of the pair of opposed cymbals and influence the operation of the cymbals.

The present invention provides an improved driving device for cymbals to mitigate and/or obviate the aforementioned problem.

SUMMARY OF THE INVENTION

One object of the present invention is to provide a driving device for cymbals which will be able to be operated with an accurate movement and so obtain a perfect performance.

In accordance with one aspect of the present invention, a driving device comprises a base mounted with a pedal, a hollow stanchion, a tripod for supporting the stanchion, a drive rod extending through the stanchion and a driving device for driving the drive rod to operate the cymbals. The driving device comprises a pair of opposed plates vertically mounted on a side pillar of the base, a bock pivotedly mounted between the pair of plates, a chain mounted to the periphery of the block, and an adjusting block having a lower end connected with the pedal and an upper end connected between the pair of plates.

In accordance with another aspect of the present invention, each of the plates defines a pair of holes at an appropriate position therein and block defines two holes respectively aligned with the pair of holes of the plates such that a pair of bolts can extend respectively through the holes defined in the plates and the block with the plates.

In accordance with a further aspect of the present invention, the pair of plates further defines a pair of large holes at a near end and the block defines a through-hole aligned with the pair of large holes of the plates such that a pivot can extend through the respective holes to pivotably engage the block with the near end of the plates.

In accordance with still a further aspect of the present invention, the periphery of the block defines a blind screw hole therein such that a bolt can screw thereinto via the chain to mount the chain to the periphery of the block.

Other objects, advantages and novel features of the invention will become more apparent from the following detailed description when taken in conjunction with the accompanying drawings.

DETAILED DESCRIPTION OF PREFERRED EMBODIMENT

Figure 1:
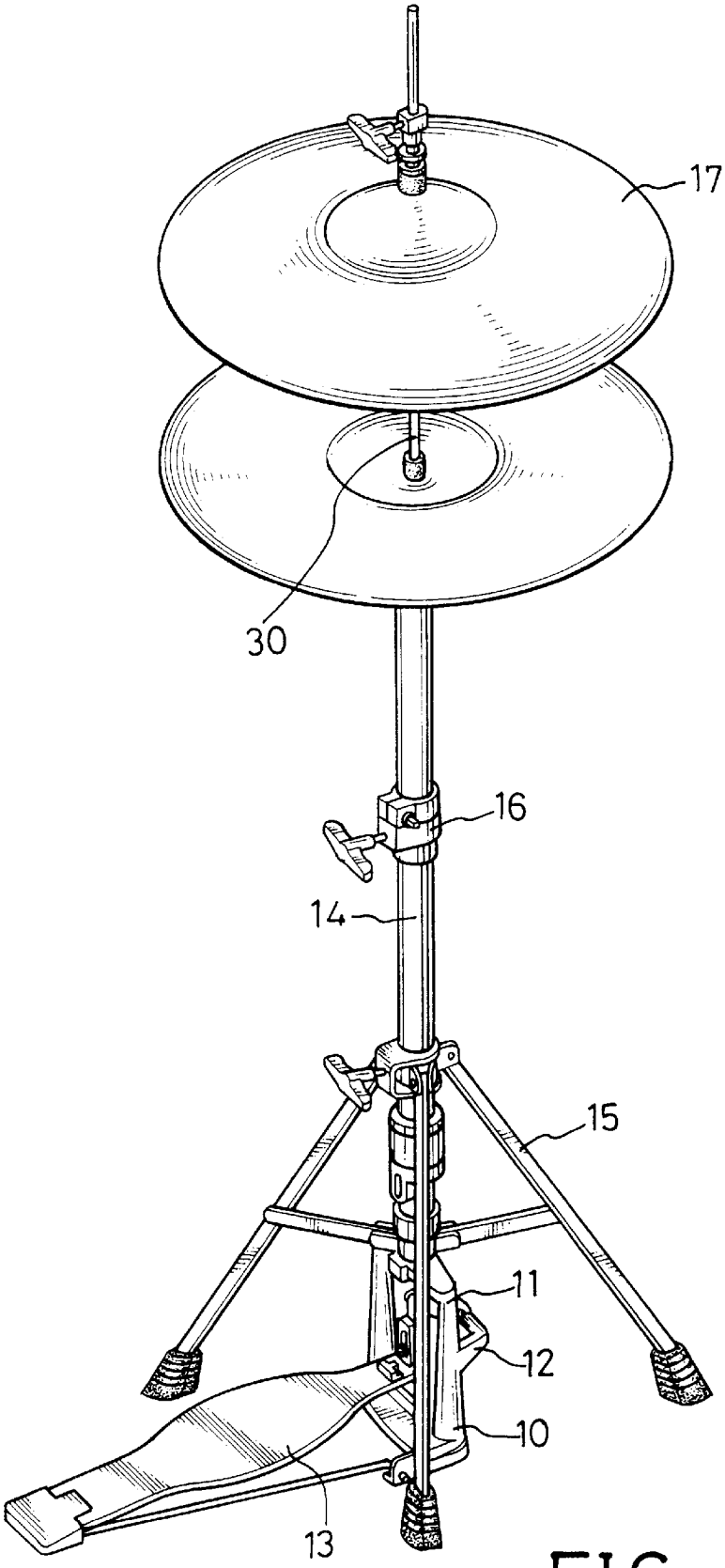
FIG. 1 is a perspective view showing a driving device for a pair of cymbals in accordance with the present invention.

Referring to FIG. 1, a cymbal device constructed in accordance with the present invention includes a base 10 mounted with a pedal 13, a stanchion 14, which is a tubular, a tripod 15 for supporting the stanchion 14, a drive rod 30 extending through the stanchion 14 and a driving device (not numbered) for driving the drive rod 30 to operate a pair of cymbals 17. A lower end of the stanchion 14 is connected with a sleeve 18 (see FIG. 3). The sleeve 18 has a U-shaped cross section and defines a central hole (not numbered) therein through which the drive rod 30 can extend. The drive rod 30 has a first end connected to the cymbals 17 and a second end connected with the driving device. The height of the cymbals 17 can be adjusted by an adjusting means 16 mounted on the stanchion 14 and the drive rod 30. The driving device is connected to the pedal 13 and mounted on a main pillar 11 and a side pillar 12, the pillars 11 and 12 both extending from the base 10.

Figure 2:
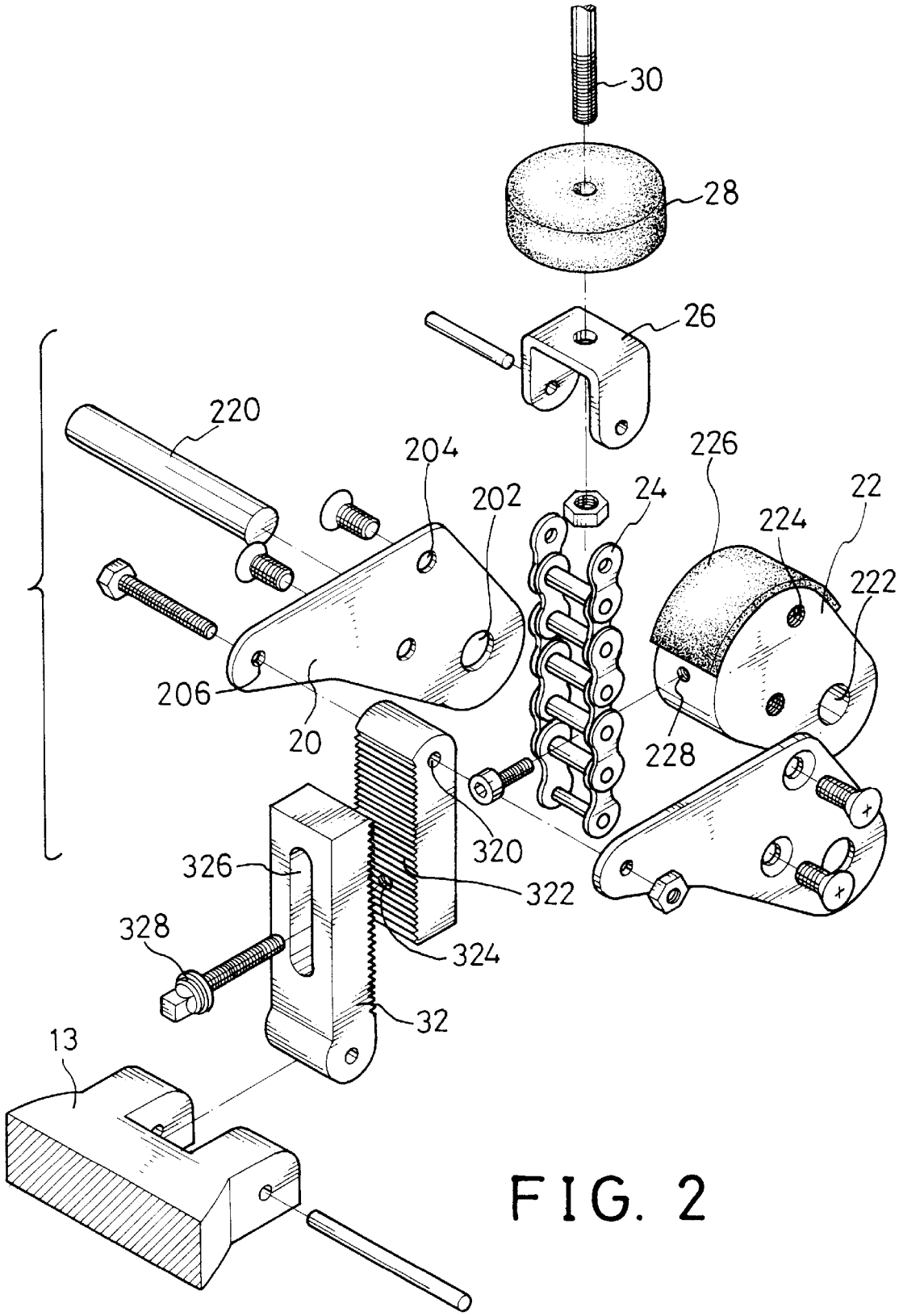
FIG. 2 is an exploded view showing the elements of the driving device for the cymbals in accordance with the present invention.
Figure 3:
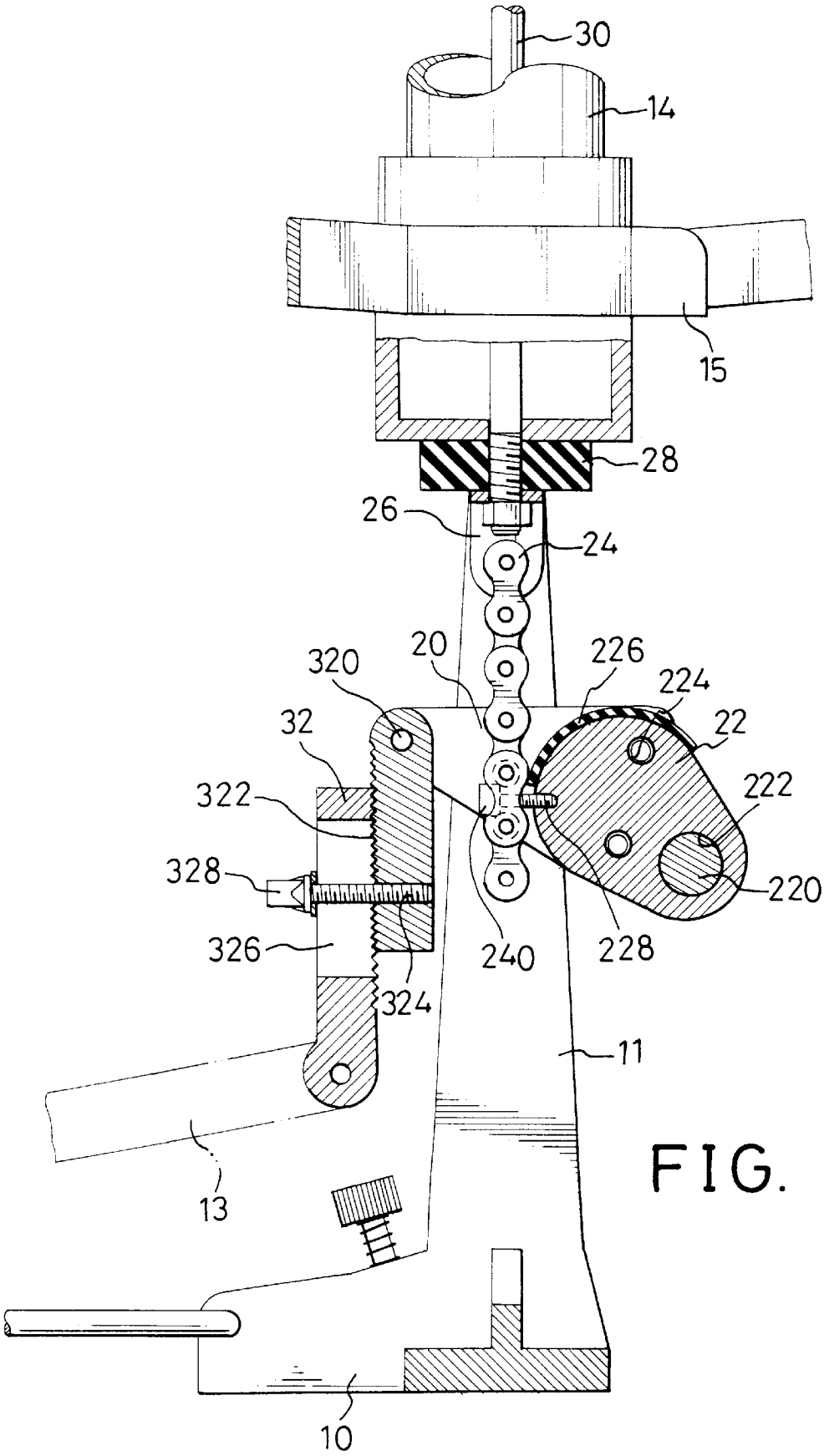
FIG. 3 is a cross-sectional view showing a combined structure of the driving device for the cymbals in accordance with the present invention.
Figure 4:
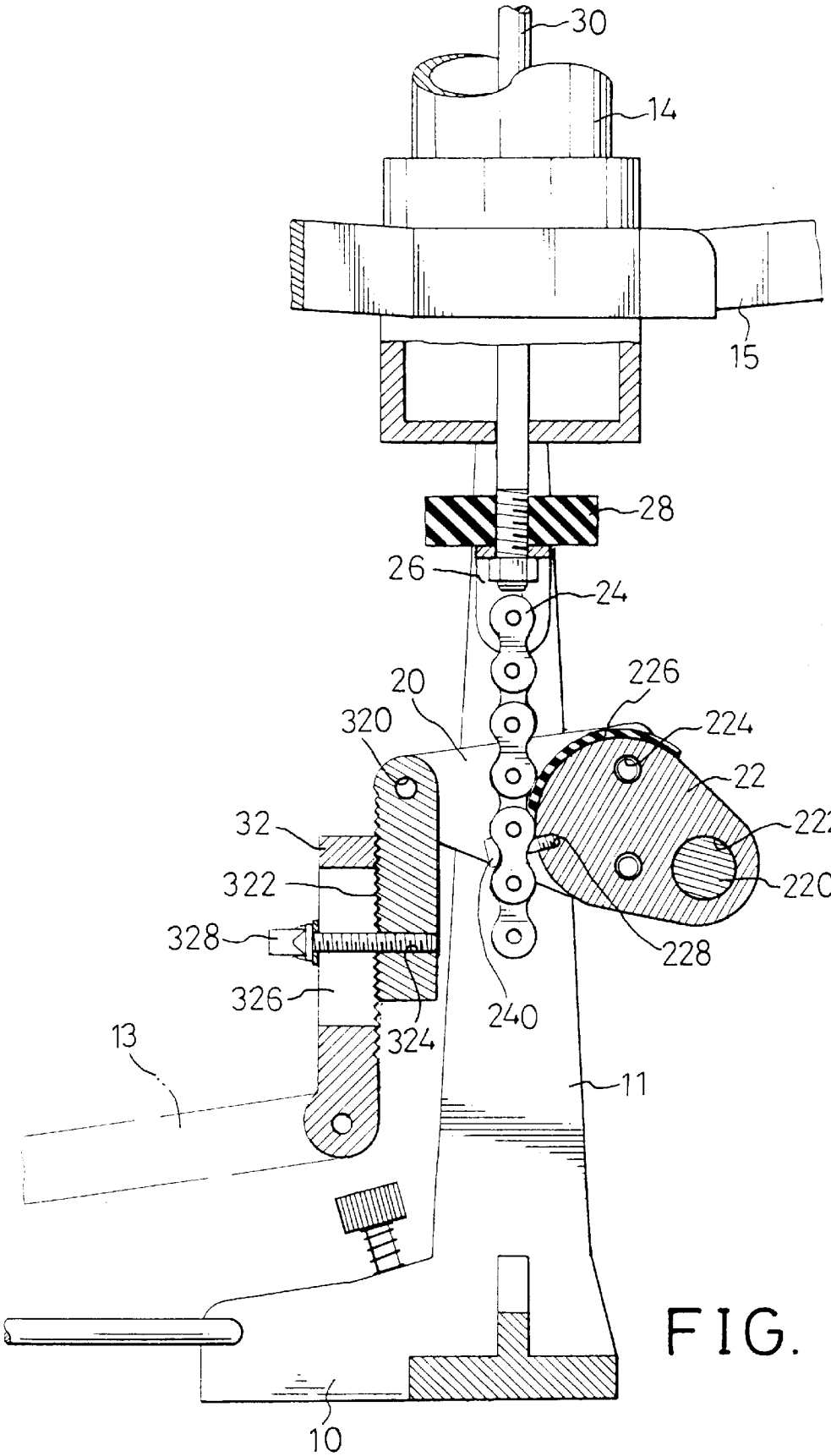
FIG. 4 is a cross-sectional side view showing the operation of the driving device for the cymbals in accordance with the present invention.
Figure 5:
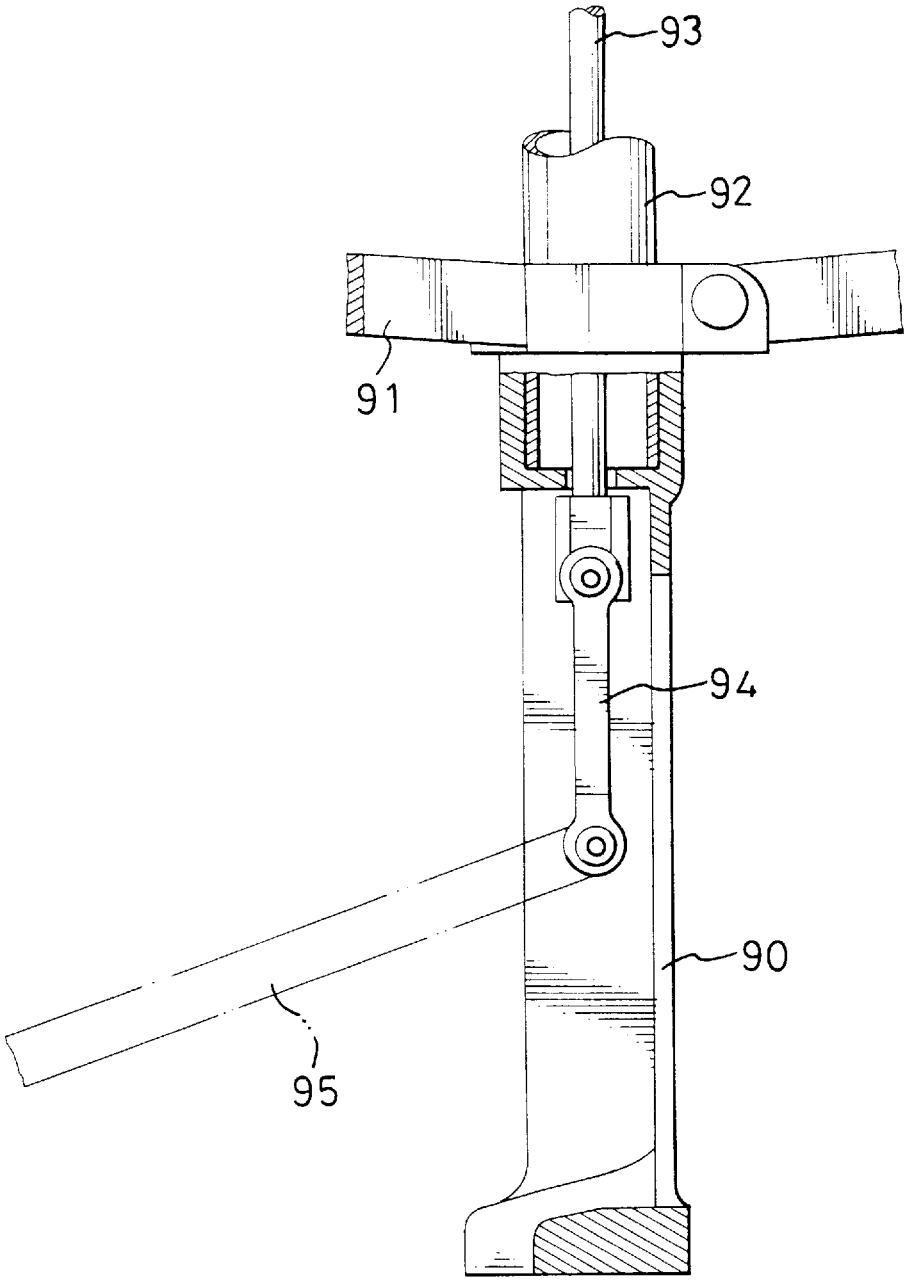
FIG. 5 PRIOR ART
FIG. 5 is a cross-sectional side view showing a conventional driving device for a pair of cymbals.
Figure 6:
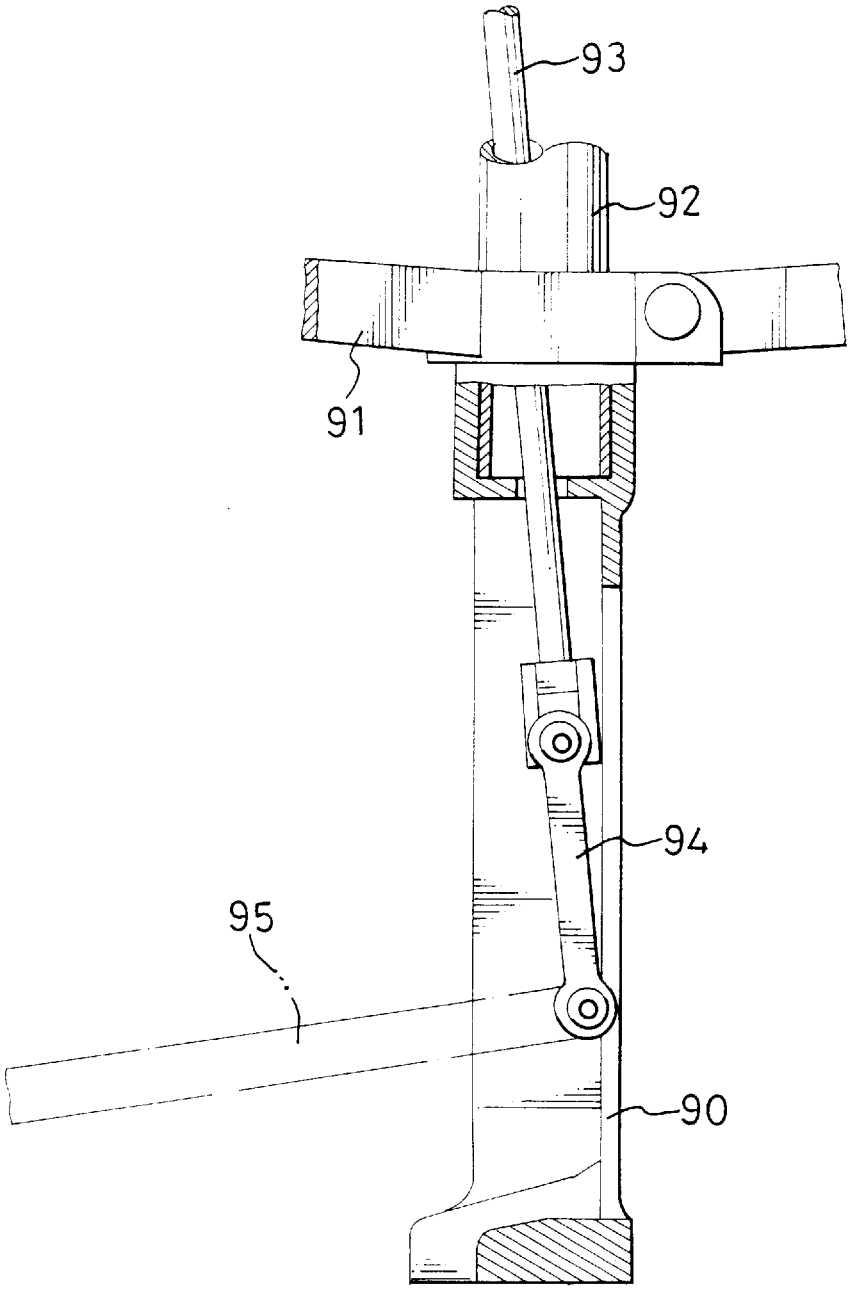
FIG. 6 PRIOR ART
FIG. 6 is a cross-sectional view showing the operation of the conventional driving device for the cymbals.

Referring to FIG. 1 and FIG. 2, the driving device includes a pair of opposed plates 20 vertically mounted on the side pillar 12. Each of the plates 20 defines a large hole 202 at a near-end thereof, a small hole 206 at a distal end and two holes 204 at an appropriate position thereon. A block 22 is sandwiched between the pair of plates 20. The block 22 defines a through-hole 222 aligned with the large holes 202 of each of the plates 20 through which a pivot 220 extends to pivotably engage the block 22 with the plates 20. The block 22 further defines two screw holes 224 respectively aligned with the two holes 204 on the plates 20 through which a pair of bolts (not numbered) can be respectively inserted to securely engage the block 22 with the plates 20. The block 22 further defines a side hole 228 on a periphery thereof. The periphery of the block 22 is curved and is covered with a cushion 226. A chain 24 is mounted partly around the periphery of the block 22 by means of a bolt 240 extending through a bottom end of the chain 24 and threadedly received in the side hole 228. The chain 24 may be a ladder-like chain and defines two opposed first holes (not numbered) in two side walls at a top end thereof. A connecting bracket 26 shaped as an inverted "U" defines two opposed second holes (not numbered) in two side walls thereof respectively aligned with the two first holes such that a pin (not numbered) can extend through the first holes and the second holes to engage the top end of the chain 24 with the connecting bracket 26. The bracket 26 further defines a central hole (not numbered) therein such that the lower end of the drive rod 30 protruding beyond the sleeve 18 can extend through the central hole and be engaged with a nut. To provide a buffer action when the driving device is operated, a pad 28 is mounted on the drive rod 30 and between the sleeve 18 and the connecting bracket 26, as shown in FIG. 3. The driving device further includes an adjusting block 32. The adjusting block 32 comprises a rear block and a front block (both are not numbered). The rear block defines a cross-bore 320 at a top end thereof aligning with the pair of opposed small holes 206 of the plates 20 by which the rear block can be engaged between the two plates 20 by a bolt and a nut. The rear block further defines a through-hole 324 at an appropriate position thereof. The front block defines a slot 326 therein in order that an adjusting bolt 328 can screw into the hole 324 via the slot 326 slackening of the adjusting bolt 328 allows the front block to move with respect to the rear block to adjust the relative positions thereof. It is to be noted that a pair of opposed faces of the front block and the rear block are correspondingly shaped serrated in order to closely attach with each other. The front block further defines a cross-bore (not numbered) at a lower end to align with a pair of opposed holes (not numbered) defined in the pedal 13, thereby to the lower end of the front block can be pivotedly engaged with the pedal 13.

Referring to FIG. 3, before the two cymbals are operated, they are separated. In this case, the pedal 13 and the drive rod 30 are located in an initial state and the chain 24 only has its bottom end contacted with the periphery of the block 22. When the pedal 13 is pressed downward by a user's foot, the combined front block move downward and thus pull down the rear block. The downward motion of the rear block will drive the plate 20 and the block 22 to pivot. With the pivoting of the block 22, the chain 24 mounted on the periphery of the block 22 is then pulled down. Since the periphery of the block 22 is covered with a cushion 226, the chain 24 will smoothly and closely abutting the periphery of the block 22 during its movement, without deviating therefrom, thus the connecting bracket 26 and the drive rod 30 connected therewith will be forcefully pulled down and finally operate the cymbals 17. Since the pulling action of the drive rod 30 is in a downward direction, an accurate operation and an excellent operation of the cymbals can be obtained. After the cymbals are operated, the user may remove the foot from the pedal 13 to allow the pedal 13 to restore to its initial state, thus the front block will release the force pulling down the rear block. In this way, the block 22 connected with the rear block will pivot reversely to drive the chain 24 to move upward, thus the connecting bracket 26 and the drive rod 30 connected therewith can restore to their initial state and the two cymbals restore to be separated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a cymbal device comprising a base mounted with a pedal, a tubular stanchion, a tripod for supporting the tubular stanchion, a drive rod extending through the tubular stanchion and a driving device for driving the drive rod to operate the cymbals, said driving device comprising:

a pair of opposed plates vertically mounted on a side pillar of the base;

a block pivotedly mounted between the pair of plates, a periphery of the block arcuately shaped;

a chain mounted to the periphery of the block, a top end of the chain being connected to the drive rod and a bottom end of the chain being connected with the block via a connecting bracket; and an adjusting block having a lower end connected with the pedal and an upper end connected between the pair of plates.

2. A driving device as claimed in claim 1, wherein each of said pair of plates defines a plurality of first holes at an appropriate position thereon and said block defines a plurality of second holes corresponding to the plurality of first holes of the plates such that a corresponding plurality of bolts can extend through each of the first holes and the second holes to engage the block with the plates.

3. A driving device as claimed in claim 1, wherein each of said pair of plates further defines a large hole at a near end and said block defines a through-hole aligned with the large hole of the plates such that a pivot can extend through the large hole and the through-hole to pivotably engage the block with the near end of the plates.

4. A driving device as claimed in claim 1, wherein said the periphery of the block defines a blind hole therein such that a bolt can extend through the bottom end of the chain and is threadedly received in the blind hole.

5. A driving device as claimed in claim 1, wherein said periphery of the block is partly covered with a cushion such that the chain can smoothly and closely abutting the periphery of the block during movement.

* * * * *